US007287875B2

(12) United States Patent
Seika et al.

(10) Patent No.: US 7,287,875 B2
(45) Date of Patent: Oct. 30, 2007

(54) AIR-FILLED FLASHING LIGHT DECORATOR

(76) Inventors: Matsushita Seika, P. O. Box 24-108, Taipei (TW); Wang Chao-Ming, P. O. Box 24-108, Taipei (TW)

( * ) Notice: Subject to any disclaimer, the term of this patent is extended or adjusted under 35 U.S.C. 154(b) by 133 days.

(21) Appl. No.: 11/069,450

(22) Filed: Mar. 2, 2005

(65) Prior Publication Data

US 2006/0198138 A1 Sep. 7, 2006

(51) Int. Cl.
*F21S 13/14* (2006.01)

(52) U.S. Cl. ..... 362/252

(58) Field of Classification Search ..... 362/252
See application file for complete search history.

(56) References Cited

U.S. PATENT DOCUMENTS 6,431,729 B1 * 8/2002 Chen ..... 362/249

* cited by examiner

*Primary Examiner*—Thomas M. Sember
*Assistant Examiner*—Julie A. Shallenberger
(74) *Attorney, Agent, or Firm*—Troxell Law Office, PLLC

(57) ABSTRACT

An air-filled flashing light decorator that has one or several ducts not connecting to the air chamber are inside the air-filled bag, the top and bottom of each duct connect to the LED light set wrapped with rubber tube and are fixed with binders, or the LED light set are fixed on the surface of the air-filled decorator; a through hole is on the bottom of the duct to fix the power wire and for power wire to pass through, such makes the LED light set and power wires install and fix inside the air-filled decorator, or the LED light set are fixed on the surface of the air-filled decorator, no hanging stable problem, nor causes the overall out-looking interference issue.

3 Claims, 4 Drawing Sheets

AIR-FILLED FLASHING LIGHT DECORATOR

BACKGROUND OF THE INVENTION

I. Field of the Invention

This invention relates generally to an air-filled decorator and, more specifically, to an air-filled flashing light decorator that aims larger size air-filled decorators such as Christmas tree, superman, Santa Claus, pumpkin . . . , with the smooth surface, these decorators are not easy to have flashing light stable, surrounding LED light might interfere the overall out-looking; with minor modification to have one or several ducts inside the air-filled decorators, the top of each duct has the LED light set wrapped with rubber tube and fix by a binder, or fix the LED light set that is on the surface of the air-filled decorator with binder, then has a through hole on bottom of the duct for the LED light and power wires to pass and be fixed, such makes the LED light and power wires installed inside the air-filled decorator; the LED light or light set can be fixed on the surface of the air-filled decorator without hanging and stable problem, nor causes the overall out-looking interference issue.

II. Description of the Prior Art

Heretofore, it is known that people pay more attention to environment protection and security consideration, and the production requirement of cartoonized decorators in demonstration makes the air-filled decorators such as Christmas tree, superman, Santa Claus, flying boat . . . are getting more and more popular; in order to be more noticeable, some flashing light are added onto those air-filled decorators, however the flashing light are not easy to be stable on the air-filled decorators, or the flashing light might not fit the overall out-looking.

SUMMARY OF THE INVENTION

It is therefore a primary object of the invention to provide an air-filled flashing light decorator that has one or several ducts not connecting to the air chamber are inside the air-filled bag, the top and bottom of each duct connect to the LED light set wrapped with rubber tube and are fixed with binders; a through hole is on the bottom of the duct to fix the power wire and for power wire to pass through, such makes the LED light set and power wires install and fix inside the air-filled decorator, no hanging stable problem, nor causes the overall out-looking interference issue.

It is still an object for the invention to provide an air-filled flashing light decorator in which one or several ducts not connecting to the air chamber are inside the air-filled bag, the top of each duct connect to the LED light set wrapped with rubber tube and are fixed with binders; a through hole is on the bottom of the duct to fix the power wire and for power wire to pass through, the LED light set are fixed on the surface of the air-filled decorator, no hanging stable problem, nor causes the overall out-looking interference issue.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 4:
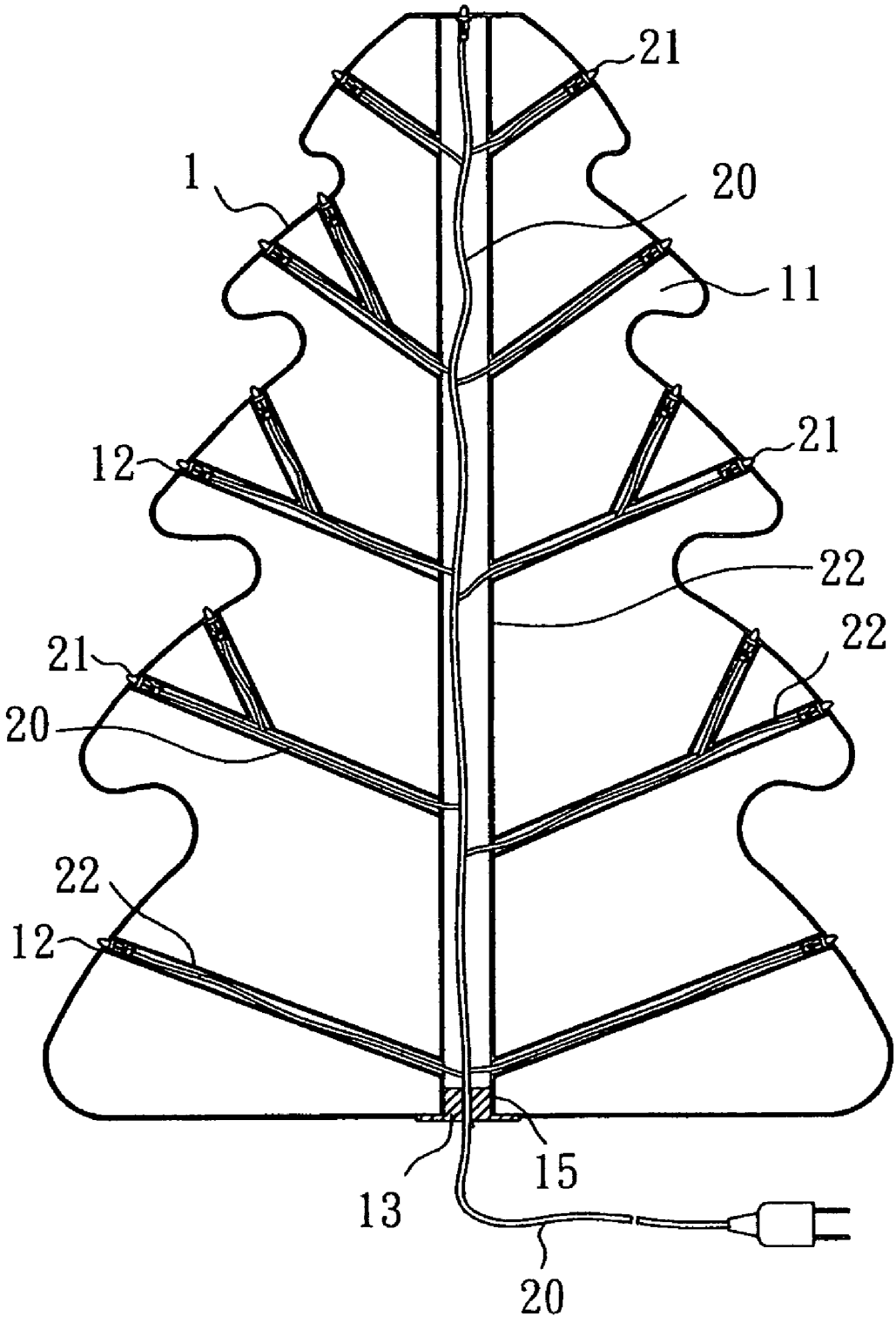
FIG. 4 is a cross-sectional view of another application of the present invention.

Referring to the figures, the present invention comprises an air-filled bag 1, an LED light set 2 and a rubber tube 3; the air-filled bag 1 has an air chamber 11 with an air inlet 10 to fill air in, one or several ducts 22 not connecting to the air chamber 11 are inside the air-filled bag 1, the top and bottom of each duct 22 connect to the light set 2 formed by LED light 21 connecting with power wires 20 and are fixed with binders 12, 13; if necessary, the LED light set 2 is wrapped and fixed with rubber tube 3 to avoid moving; or referring to FIG. 4, the LED light 21 on the surface of the air-filled bag 1 are fixed by the binders 12, the power wires 20 connecting to the LED light 21 are installed inside the ducts 22, the through hole 15 on the bottom of the duct 22 is wrapped by a binder 13 to fixed the power wire 20 and for power wire 20 to pass through.

Figure 1:
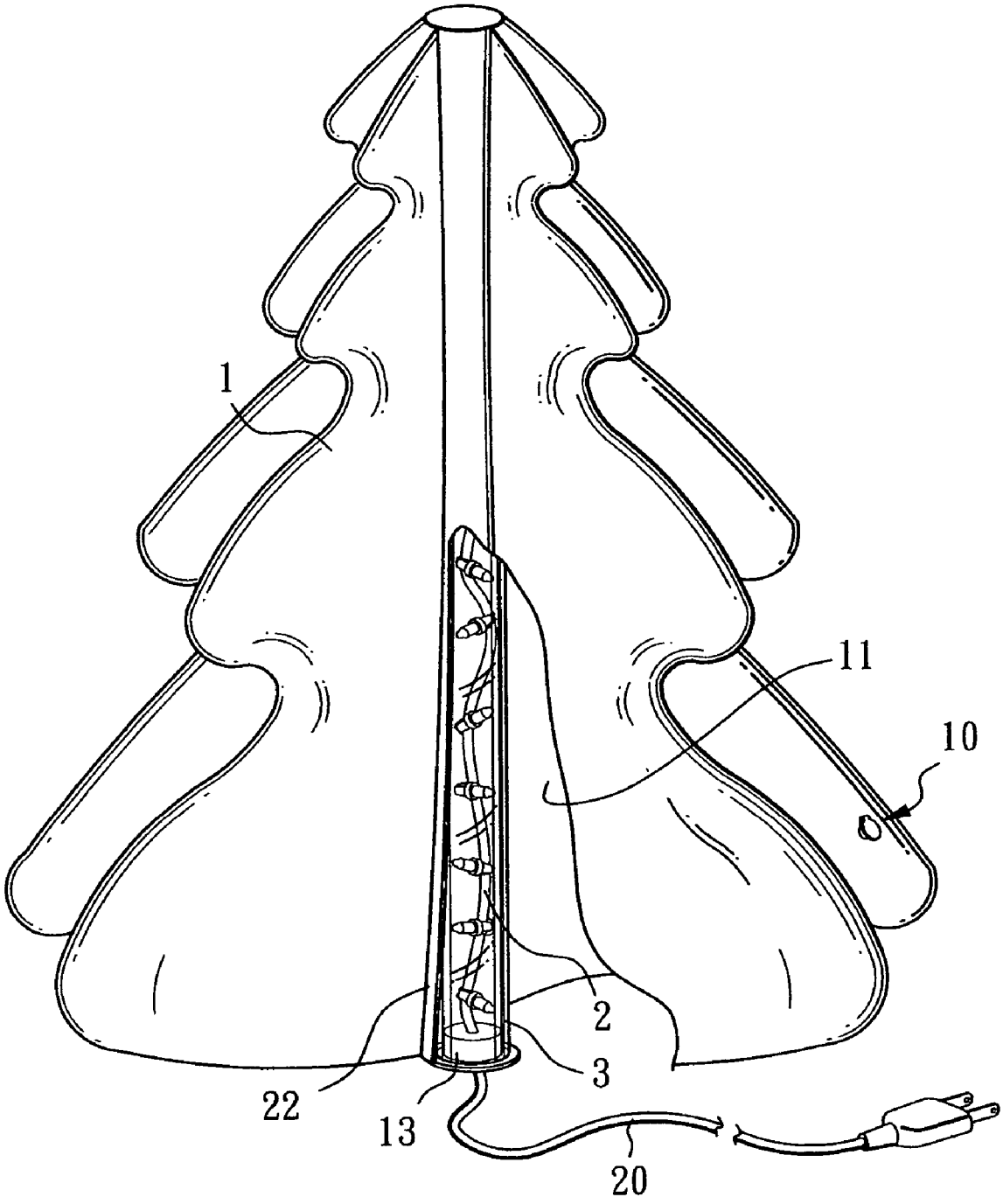
FIG. 1 is a perspective view of the present invention.
Figure 2:
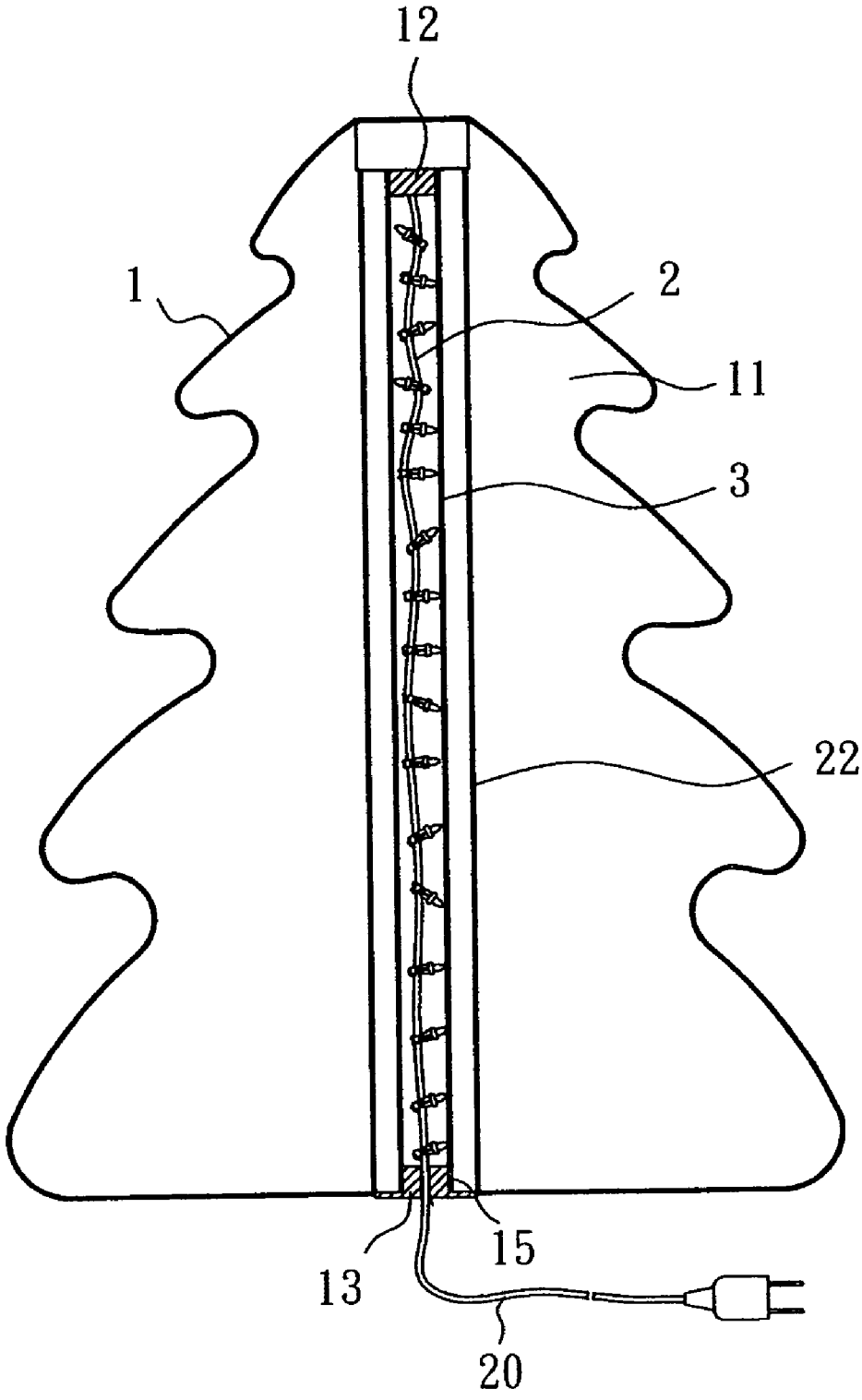
FIG. 2 is a cross-sectional view of the present invention.
Figure 3:
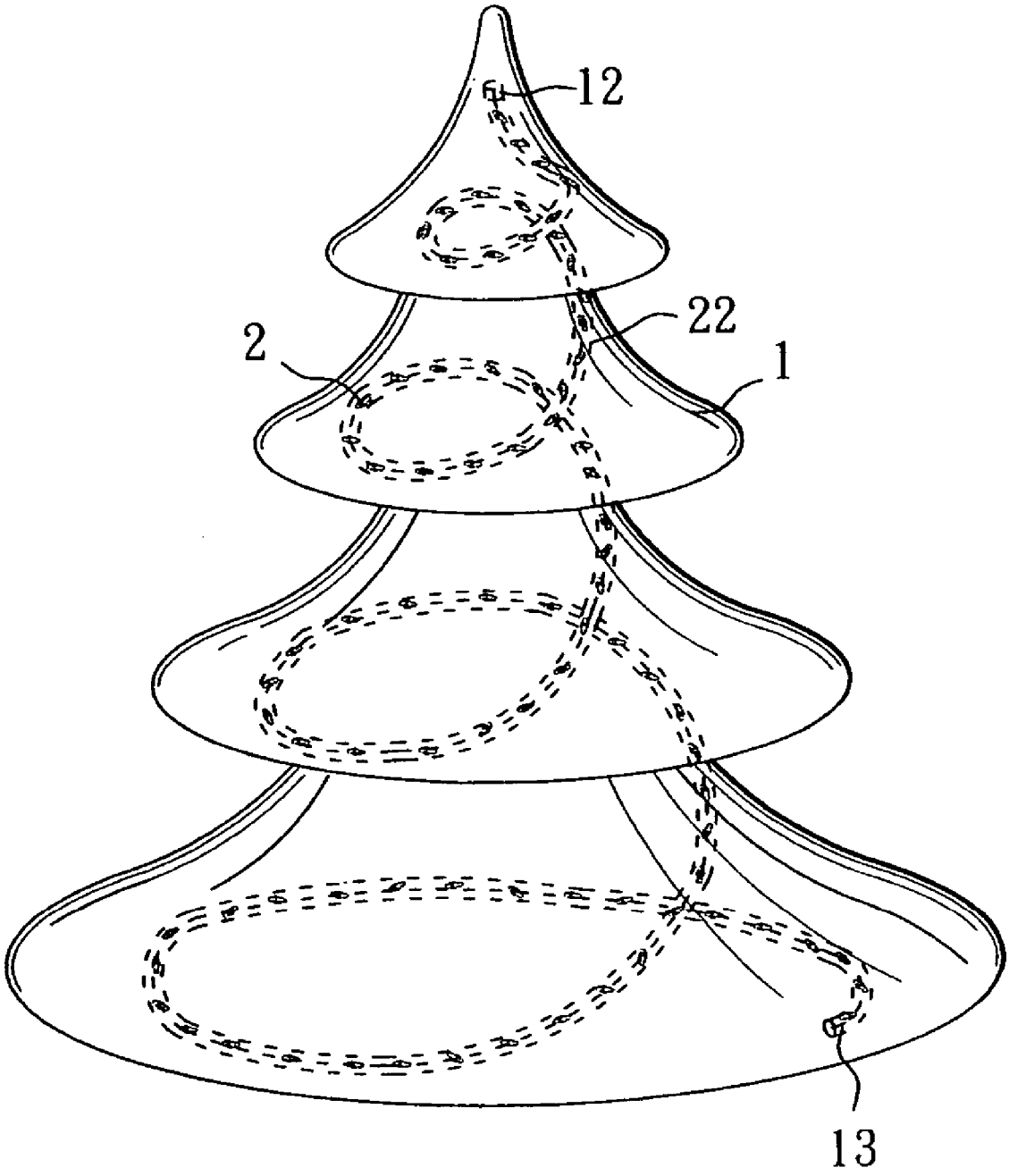
FIG. 3 is a perspective view of another application of the present invention.

While application, as shown in FIG. 1 to FIG. 3, with the LED light set 2 and power wires 20 are installed inside the ducts 22 of the air-filled bag 1 and are fixed by the binders 12, 13, after air is blown from the air inlet 10 into the air-filled bag 1, the LED light set 2 is fixed between the ducts 22, the LED light set 2 can be wrapped by the rubber tube 3 to stable LED light 21 inside the ducts 22 without moving; when the power is on, the air-filled bag 1 is with flashing light; as shown in FIG. 4, the LED light 21 are fixed on the surface of the air-filled bag 1 by binders 12, and the power wires 20 are inside the ducts 22, after power is on, the air-filled bag 1 has flashing light effect on surface, both methods will not be effected the flashing light out-looking by moving or hanging.

While a preferred embodiment of the invention has been shown and described in detail, it will be readily understood and appreciated that numerous omissions, changes and additions may be made without departing from the spirit and scope of the invention.

What is claimed is:

1. An air-filled flashing light decorator comprising:

an air-filled bag having an air chamber and an air inlet adapted for inflating and deflating the air-filled bag;

an at least one duct extending through the air-filled bag, the at least one duct forming an interior space separate from the air chamber; and an LED light set extending through the at least one duct, the LED light set being connected to a power wire at one end of the LED light set, wherein the LED light set is affixed with at least one binder to an opening in the at least one duct, wherein the at least one binder is multiple binders and the at least one duct is formed by a central duct having branch ducts which branch from the central duct and extend to a surface of the air-filled bag, wherein the LED light set are fixed at an end of each of the branch ducts with binders, wherein the binders are spread on the surface of the air-filled bag and the power wires extend through both the central duct and the branch ducts.

2. The air-filled flashing light decorator recited in claim 1, wherein the at least one surrounds the LED light to stabilize the LED light set.

3. The air-filled flashing light decorator recited in claim 1, wherein the LED light set is affixed to both a top opening and a bottom opening of the at least one duct.

* * * * *